US008611807B2

(12) United States Patent
Murao

(10) Patent No.: US 8,611,807 B2
(45) Date of Patent: Dec. 17, 2013

(54) IMAGE FORMING APPARATUS

(75) Inventor: Hidetoshi Murao, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 253 days.

(21) Appl. No.: 13/090,487

(22) Filed: Apr. 20, 2011

(65) Prior Publication Data

US 2011/0262199 A1 Oct. 27, 2011

Related U.S. Application Data

(60) Provisional application No. 61/326,535, filed on Apr. 21, 2010.

(51) Int. Cl.
*G03G 15/00* (2006.01)
*G03G 13/00* (2006.01)

(52) U.S. Cl.
USPC ..... 399/394; 399/388; 399/390; 399/66; 399/302; 399/316; 271/227

(58) Field of Classification Search
USPC ..... 399/388, 390, 66, 302, 316, 317; 271/227
See application file for complete search history.

(56) References Cited

U.S. PATENT DOCUMENTS

| | | | | |
|---|---|---|---|---|
| 3,837,461 | A * | 9/1974 | Waibel | 400/56 |
| 5,602,636 | A * | 2/1997 | Matsuzawa | 399/388 |
| 5,678,122 | A * | 10/1997 | Gross | 399/16 |
| 6,198,903 | B1 * | 3/2001 | Benedict | 399/388 |
| 6,493,534 | B2 * | 12/2002 | Sawanaka et al. | 399/316 |
| 6,572,292 | B2 * | 6/2003 | Kelley et al. | 400/627 |
| 7,099,615 | B2 * | 8/2006 | Izumi | 399/316 |
| 7,383,006 | B2 * | 6/2008 | Matsuura | 399/316 |
| 7,636,100 | B2 * | 12/2009 | Maebashi | 347/153 |
| 7,706,734 | B2 * | 4/2010 | Higashimura et al. | 399/316 |
| 8,126,387 | B2 * | 2/2012 | Noguchi et al. | 399/396 |
| 8,295,746 | B2 * | 10/2012 | Matsumoto | 399/302 |
| 2004/0170457 | A1 * | 9/2004 | Kamimura et al. | 399/388 |
| 2009/0010675 | A1 * | 1/2009 | Suzuki | 399/101 |
| 2009/0134571 | A1 * | 5/2009 | Kotaka | 271/264 |
| 2011/0305490 | A1 * | 12/2011 | Richards et al. | 399/316 |
| 2012/0051765 | A1 * | 3/2012 | Kuroda et al. | 399/44 |
| 2012/0134723 | A1 * | 5/2012 | Nojima | 399/316 |

FOREIGN PATENT DOCUMENTS

| | | | |
|---|---|---|---|
| JP | 10069170 | A | 3/1998 |
| JP | 2008009034 | A * | 1/2008 |

* cited by examiner

*Primary Examiner* — Matthew G Marini
*Assistant Examiner* — Quang X Nguyen
(74) *Attorney, Agent, or Firm* — Patterson & Sheridan, LLP

(57) ABSTRACT

An image forming apparatus can form a high-quality image without a toner image being rubbed with and transferred onto a sheet. The apparatus includes: an image carrier that transfers a toner image onto a sheet; a transport roller disposed upstream of a transfer position where the toner image is transferred onto the sheet from the image carrier in a sheet transport direction, and closest to the transfer position among rollers transporting the sheet; a guide section arranged between the transfer position and the transport roller, and changing over between a first guide state where the transported sheet is guided to contact a surface of the image carrier with a first contact area, and a second guide state where the transported sheet is guided to contact the surface of the image carrier with a second contact area smaller than the first contact area; and a guide control section allows the guide section to guide the transported sheet in the second guide state when the rear edge of the transported sheet passes through the transport roller.

8 Claims, 6 Drawing Sheets

IMAGE FORMING APPARATUS

CROSS-REFERENCE TO RELATED APPLICATION

This application is based upon and claims the benefit of priority from U.S. provisional application 61/326,535, filed on Apr. 21, 2010; the entire contents of each of which are incorporated herein by reference.

FIELD

Embodiments described herein relate to a sheet transporting method in an image forming apparatus.

BACKGROUND

Up to now, in an image forming apparatus such as an MFP (multi function periphery), sheets fed from a sheet feeder are transported by transport rollers disposed along a transport path. Each of the sheets transported in the transport path is transported to a transfer section by a transport roller pair called "registration rollers" disposed upstream of the transfer section in a transport direction, and a toner image is transferred onto the sheet in the transfer section.

When the transported sheet passes through the transfer section, the sheet changes from a state in which the sheet is held at two portions of a transfer belt and a transfer roller, and the registration rollers downstream of a transfer position, and transported, to a state in which a rear edge of the sheet goes through the registration rollers, and held only at the transfer position.

When the rear edge of the sheet goes through the registration rollers, because a retentive force is not exerted on the rear edge of the sheet, the rear edge of the sheet may flap, and act up. If the rear edge of the sheet acts up, the sheet is rubbed with the transfer belt before the transfer position. If the sheet is rubbed with the transfer belt, toner is rubbed against the sheet and adheres to the sheet, and an image on the sheet goes wrong.

DETAILED DESCRIPTION

An embodiment includes an image carrier, a transport roller, a guide section, and a guide control section.

The image carrier transfers a toner image onto a sheet. The transport roller is disposed upstream of a transfer position, at which the toner image is transferred from the image carrier to the sheet, in a sheet transport direction. The transport roller is nearest to the transfer position among the rollers that transport the sheet. The guide section is arranged between the transfer position and the transport roller. The guide section changes over between a first guide state in which the transported sheet is so guided as to contact a surface of the image carrier with a first contact area, and a second guide state in which the transported sheet is so guided as to contact the surface of the image carrier with a second contact area smaller than the first contact area. The guide control section allows the guide section to guide the transported sheet in the second guide state when the rear edge of the transported sheet passes through the transport roller.

First Embodiment

Hereinafter, a first embodiment will be described with reference to the accompanying drawings.

Figure 1:
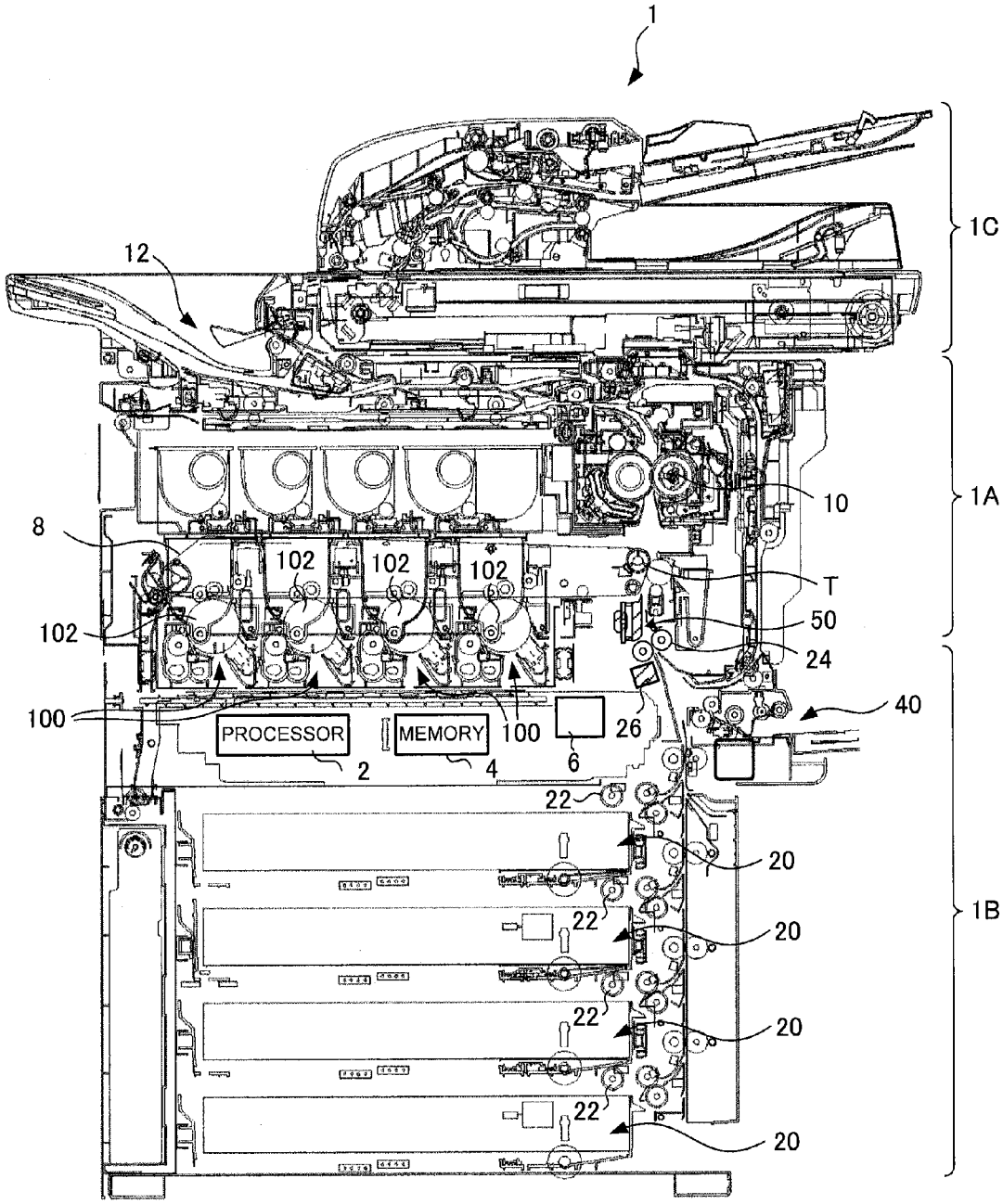
FIG. 1 is a diagram illustrating a configuration of an image forming apparatus according to an embodiment.
Figure 2:
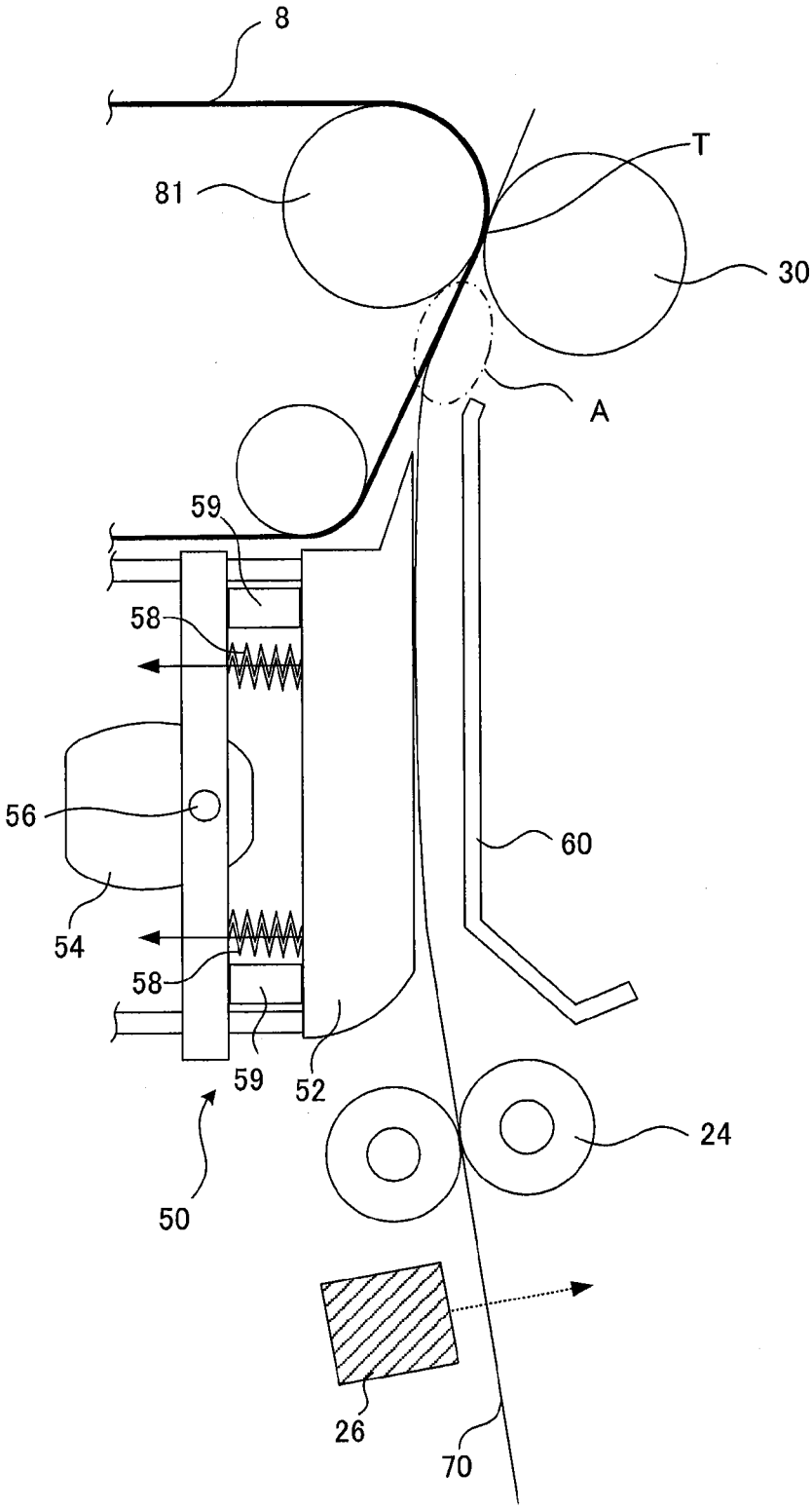
FIG. 2 is an enlarged diagram illustrating a secondary transfer position portion of the image forming apparatus.
Figure 3:
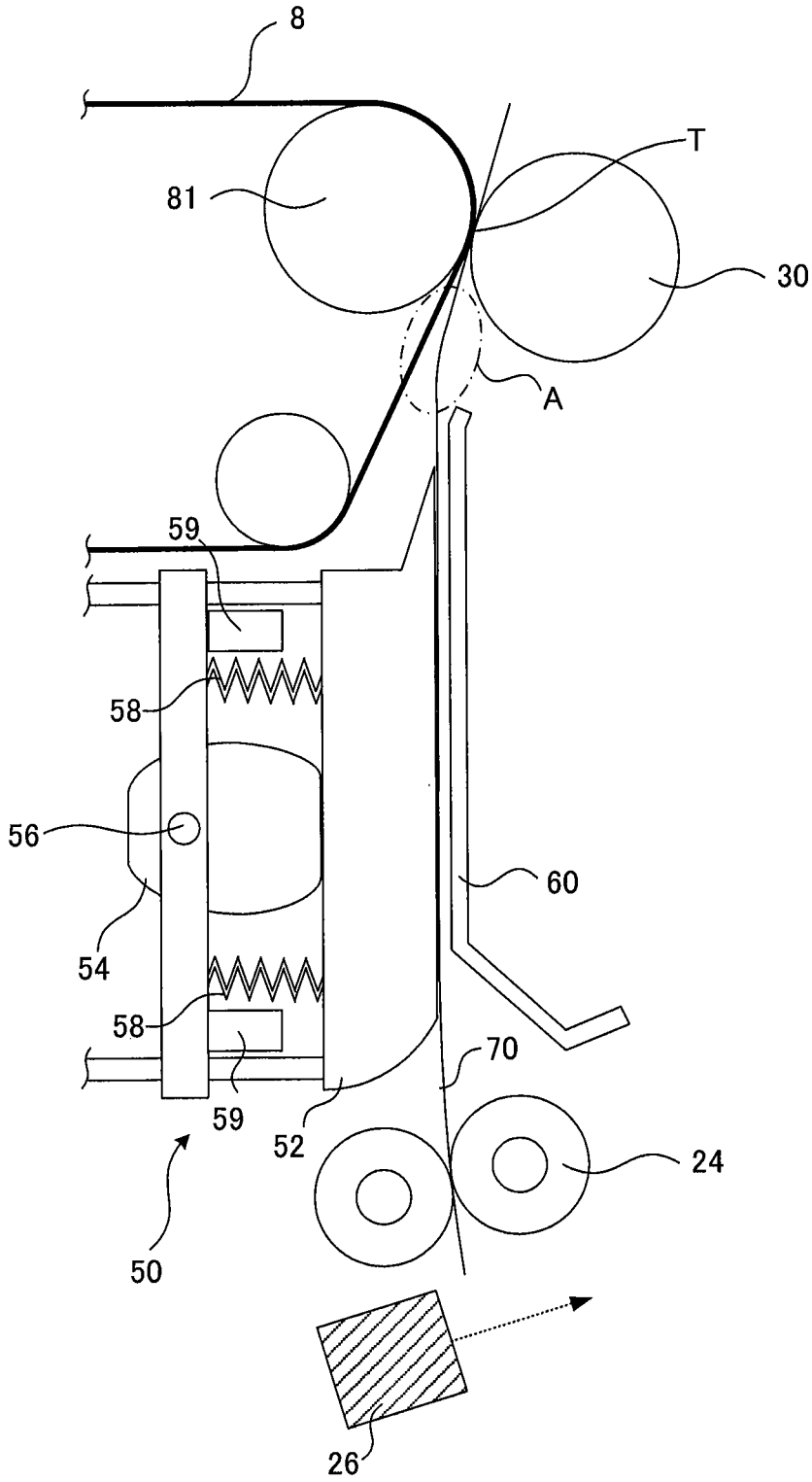
FIG. 3 is an enlarged diagram of the secondary transfer position portion.

FIG. 1 is a diagram illustrating a configuration of an image forming apparatus 1 according to this embodiment. FIGS. 2 and 3 are enlarged diagrams of a secondary transfer position T portion of the image forming apparatus 1.

The image forming apparatus 1 is an MFP (multi function periphery) that executes printing, copying, and scanning. The image forming apparatus 1 includes an image formation section 1A, a sheet feed section 1B, an image read section 1C, a processor 2, a memory 4, and an auxiliary storage device 6.

First, the image formation section 1A forms an image on the sheet in printing and copying. The image formation section 1A forms the image on the sheet such as a paper supplied from the sheet feed section 1B on the basis of a print job and a copy job.

The image formation section 1A includes four process units 100 corresponding to yellow, magenta, cyan, and black, an intermediate transfer belt 8 as an image carrier, a secondary transfer roller 30, and a fixing device 10.

Each of the process units 100 forms a toner image (developer image) of a corresponding color onto the intermediate transfer belt 8. Each of the process units 100 includes a photosensitive drum 102, a developing unit, and a primary transfer roller.

The toner images formed on the photosensitive drums corresponding to the respective colors are superimposed and transferred (primary transfer) from the photosensitive drums onto the intermediate transfer belt 8 to form one toner image on the intermediate transfer belt 8. The intermediate transfer belt 8 transfers the formed toner image onto the sheet at a secondary transfer position T.

The secondary transfer roller 30 nips the sheet in cooperation with a secondary transfer opposed roller 81 that faces the secondary transfer roller 30 through the intermediate transfer belt 8 at the secondary transfer position T. The secondary transfer roller 30 then transfers the toner image formed on the intermediate transfer belt 8 onto the transported sheet.

The fixing device 10 fixes the toner image, which is transferred onto the sheet at the secondary transfer position T, onto the sheet by heat.

An outline of image formation conducted by the image formation section 1A configured as described above will be described. First, when the image forming apparatus 1 acquires a copy job or a print job, the surfaces of the photosensitive drums 102, which is charged by electrostatic chargers in the respective process units 100, are irradiated with a laser beam on the basis of image data of the acquired job to form an electrostatic latent image. Each developer unit supplies toner to the photosensitive drum 102 on which the electrostatic latent image is formed. The supply of toner visualizes the electrostatic latent image formed on the photosensitive drum 102. Then, each photosensitive drum 102 primarily transfers the toner image onto the intermediate transfer belt 8 at the primary transfer position where the primary transfer roller is located. With rotation of the intermediate transfer belt 8, the toner images of the respective colors are sequentially primarily transferred from the photosensitive drums 102 for the respective colors to form the toner image corresponding to the image data on the intermediate transfer belt 8. Then, at the secondary transfer position T, the toner image is secondarily transferred onto the sheet transported from a sheet cassette 20. The sheet onto which the toner image is transferred travels to the fixing device 10. The fixing device 10 fixes the toner image on the sheet by heating. The sheet on which the toner image is fixed is output to a sheet output tray 12 through the transport path. The outline of the image formation conducted by the image forming apparatus 1 is described above.

The sheet feed section 1B supplies the sheet to the image formation section 1A. The sheet feed section 1B includes the sheet cassettes 20, pickup rollers 22, transport rollers 24, a sensor 26, and a guide section 50. FIG. 1 illustrates the image forming apparatus having the four sheet cassettes 20 and the four pickup rollers 22.

Each of the sheet cassettes 20 receives sheets such as papers on which images are to be formed.

Each of the pickup rollers 22 picks up the sheets from each of the sheet cassettes 20 one by one. The sheet picked up by the pickup roller 22 is transported toward the secondary transfer position T by the other transport rollers disposed along the transport path.

The transport rollers 24 are a roller pair that transports the sheet to the secondary transfer position T, and also called "registration rollers". The transport rollers 24 are a roller pair disposed at a position closest to the secondary transfer position T at the upstream side in the sheet transport direction among the rollers disposed along the transport path for the sheets.

The sensor 26 detects the pass of the sheet. The sensor 26 is disposed at a position adjacent to the transport rollers 24 at the upstream side in the sheet transport direction, and detects the sheet that passes through a position before the transport rollers 24.

The guide section 50 guides the sheet transported by the transport rollers 24 to the secondary transfer position T. Then, the guide section 50 according to this embodiment prevents the sheet from being rubbed with and contacting the intermediate transfer belt 8 due to a fact that the sheet acts up immediately after the rear edge of the sheet passes through the transport roller 24. The guide section 50 according to this embodiment includes a movable guide portion 52, a guide drive cam 54, a support shaft 56, a spring 58, a positioning member 59, and a fixed guide portion 60.

The movable guide portion 52 is movably fixed so as to come closer to or go apart from the facing fixed guide portion 60. Specifically, the movable guide portion 52 travels between a position apart from the facing fixed guide portion 60 as illustrated in FIG. 2, and a position close to the fixed guide portion 60 side as illustrated in FIG. 3 (in the present specification, the position at which the movable guide portion 52 is apart from the fixed guide portion 60 illustrated in FIG. 2 is also called "apart position". Also, the position at which the movable guide portion 52 is close to the fixed guide portion 60 illustrated in FIG. 3 is also called "close position".)

Now, a description will be given of the operation of the guide section 50 in this embodiment, particularly transport of the sheet when the movable guide portion 52 is at the close position and at the apart position.

First, the sheet fed from the sheet cassettes 20 in the sheet feed section 1B is transported by the transport rollers 24, and passes through the guide section 50, and an image is transferred at the secondary transfer position T.

In this situation, the movable guide portion 52 guides the sheet at the apart position (first guide state), and the transport rollers 24 transports the sheet 70 at an angle where the sheet 70 is pressed against the intermediate transfer belt 8. Therefore, the sheet 70 is transported in a state where the sheet 70 contacts the intermediate transfer belt 8 from a position upstream of the secondary transfer position T in the sheet transport direction. Specifically, as illustrated in FIG. 2, in a range A from the secondary transfer position T of the intermediate transfer belt 8 to the position at the upstream side in the sheet transport direction, the sheet 70 is abutted against the intermediate transfer belt 8. This is because the sheet 70 is abutted against a position before the secondary transfer position T of the intermediate transfer belt 8, and a contact area with the intermediate transfer belt 8 increases to improve the transfer property of the toner image onto the sheet 70.

On the other hand, when the movable guide portion 52 guides the sheet 70 at the close position (second guide state), the sheet 70 is pressed against the fixed guide portion 60 side. As a result, the sheet 70 is guided and fed to a position closer to the secondary transfer position T than that when the movable guide portion 52 is at the apart position. When the sheet 70 is transported to a position closer to the secondary transfer position T, the sheet 70 is transported in a state where the sheet 70 is apart from the intermediate transfer belt 8 upstream of the secondary transfer position T in in the sheet transport direction. Specifically, as illustrated in FIG. 3, when the movable guide portion 52 is at the close position to the fixed guide portion 60, the sheet 70 is transported in a state where the contact area of the sheet 70 in the range A is smaller than that when the movable guide portion 52 is at the apart position.

When the contact area of the sheet 70 with the intermediate transfer belt 8 upstream of the secondary transfer position T in the sheet 70 transport direction is small, a nipping force by the transport rollers 24 is lost as soon as the sheet 70 passes through the transport rollers 24, and the sheet 70 is not nipped by the transport rollers 24. Then, even if the sheet 70 flaps, that the sheet 70 is rubbed with and contacts the intermediate transfer belt 8 can be suppressed to the minimum.

Also, when the movable guide portion 52 is at the close position, an interval between the guide surface of the movable guide portion 52 and the guide surface of the fixed guide portion 60 is also narrowed. Accordingly, even if the sheet 70 flaps immediately after passing through the transport rollers 24, motion that the sheet 70 acts up and flaps can be pressed and suppressed as compared with a case where the movable guide portion 52 is at the apart position.

On the contrary, when the sheet 70 contacts the intermediate transfer belt 8 from a position upstream of the secondary transfer position T in the sheet transport direction, the rear edge of the sheet 70 flaps and acts up immediately after the rear edge of the sheet 70 passes through the transport rollers 24. In this case, a phenomenon occurs in which a portion where the sheet 70 contacts the intermediate transfer belt 8 in the range A is rubbed with the surface of the intermediate transfer belt 8. When the sheet 70 is rubbed with and contacts the intermediate transfer belt 8, the toner image formed on the intermediate transfer belt 8 is also rubbed with and transferred onto the sheet 70. As a result, an image formed on the sheet 70 goes wrong. Also, if the movable guide portion 52 is at the apart position, because an interval from the fixed guide portion 60 is large, the acting up of the sheet 70 cannot be suppressed.

If the movable guide portion 52 is at the apart position from the fixed guide portion 60, an interval between the guide surface of the movable guide portion 52 and the guide surface of the fixed guide portion 60 can be set to, for example, about 3 to 4 mm although not particularly limited. Also, if the movable guide portion 52 is at the close position, it is preferable that the interval between those guide surfaces allows the sheet to be pressed so as to prevent the sheet 70 from acting up while the transport of the sheet 70 is not prevented. The interval of those guide surfaces at the close position thereof can be set to about 1.5 mm, for example, if the image is formed on a plain paper.

The guide drive cam 54 rotates about the support shaft 56 by a cam drive portion such as a motor not shown, and moves the movable guide portion 52 to the apart position and the close position.

The spring 58 is an elastic member that attracts the movable guide portion 52 to the apart position side.

The positioning member 59 positions the apart position of the movable guide portion 52.

With the guide drive cam 54, the spring 58, and the positioning member 59, the movable guide portion 52 can move from the apart position to the close position, and move from the close position to the apart position. Specifically, as illustrated in FIG. 3, if the guide drive cam 54 rotates, and the cam surface farther from the support shaft 56 is abutted against the movable guide portion 52, the movable guide portion 52 moves to the close position against a force of the spring 58. On the other hand, as illustrated in FIG. 2, if the guide drive cam 54 rotates and is not abutted against the movable guide portion 52, the movable guide portion 52 is pulled by the force of the spring 58 and moves. Then, the movable guide portion 52 is abutted against the positioning member 59, and stops. A position at which the movable guide portion 52 is abutted against the positioning member 59, and stops is the apart position.

The fixed guide portion 60 is a guide of the transported sheet 70 which is disposed at a position facing the movable guide portion 52. As described above, when the movable guide portion 52 moves to the close position to the fixed guide portion 60, the interval between the guide surfaces thereof is narrowed. If the interval between the guide surfaces thereof is narrowed, the flap (act-up) of the sheet when the sheet 70 passes through the transport rollers 24 can be suppressed.

The sheet feed section 1B feeds the sheet to the image formation section 1A. The sheet feed section 1B includes the sheet cassettes 20 and the pickup rollers 22 (four sets in FIG. 1).

The image read section 1C is a device that reads an image from an original when coping or scanning is executed, which is an image reader provided in a copying machine and an image scanner.

The processor 2 is a processor that controls various processing in the image formation section 1A, the sheet feed section 1B, and the image read section 10. The processor 2 executes a program stored in the memory 4 or the auxiliary storage device 6 to realize various functions and execute processing. The processor 2 is formed of a CPU (central processing unit) or an MPU (micro processing unit) that can execute an arithmetic processing equivalent to that in the CPU. Also, a part or all of the functions provided in the image forming apparatus 1 may be realized by an ASIC (application specific integrated circuit) as a processor.

The memory 4 is a so-called main storage device that stores a program allowing the processor 2 to execute processing such as image forming in the image formation section 1A, sheet supplying in the sheet feed section 1B, image reading in the image read section 1C. Also, the memory 4 provides a temporal work area to the processor 2. The memory 4 is, for example, a RAM (random access memory), a ROM (read only memory), a DRAM (dynamic random access memory), an SRAM (static random access memory), a VRAM (video RAM), or a flash memory.

The auxiliary storage device 6 stores various pieces of information in the image forming apparatus 1. The auxiliary storage device 6 is, for example, a magnetic storage device such as a hard disk drive, an optical storage device, a semiconductor storage device (flash memory), or a combination of those storage devices.

The configuration of the image forming apparatus 1 according to this embodiment is described above.

Figure 4:
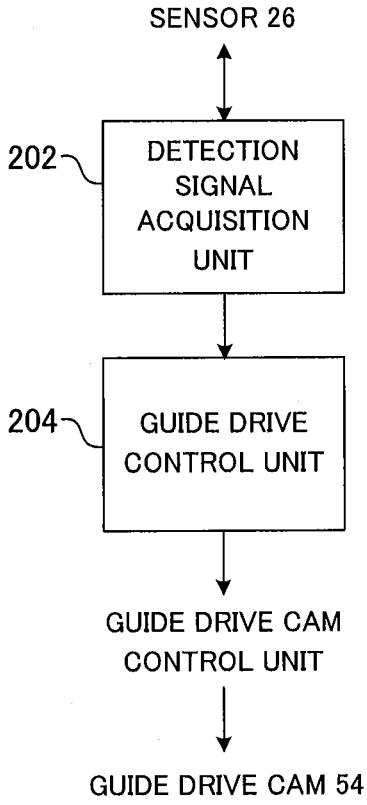
FIG. 4 is a functional block diagram illustrating the image forming apparatus.

Subsequently, sheet transporting in the image forming apparatus 1 according to this embodiment will be described. FIG. 4 is a functional block diagram of the image forming apparatus 1 according to this embodiment.

The image forming apparatus 1 includes a detection signal acquisition unit 202 and a guide drive control unit 204.

The detection signal acquisition unit 202 acquires a signal from the sensor 26, indicating that the rear edge of the sheet 70 passes. Specifically, the sensor 26 turns on (or off) when the front edge of the sheet 70 passes through a detection position of the sensor 26. Then, when the sheet 70 is transported to the transport rollers 24, and passes through the secondary transfer position T, and the rear edge of the sheet 70 passes through the detection position of the sensor 26, the sensor 26 turns off (or on). Accordingly, the detection signal acquisition unit 202 acquires the detection signal from the sensor 26 corresponding to detection that the rear edge of the sheet passes as the detection signal indicating that the rear edge of the sheet 70 passes.

The guide drive control unit 204 moves the movable guide portion 52 to the close position when the rear edge of the sheet 70 passes through the transport rollers 24, and prevents toner image from being rubbed due to the acting-up of the sheet 70. For that reason, in this embodiment, when the detection signal acquisition unit 202 acquires the signal indicating that the rear edge of the sheet 70 passes, the guide drive control unit 204 moves the movable guide portion 52 to the close position on the basis of the acquired signal.

Specifically, when the detection signal acquisition unit 202 acquires the above signal, the guide drive control unit 204 controls the drive of the guide drive cam 54, and rotates the guide drive cam 54 on the basis of a time required until the rear edge of the sheet 70 passes through a nip portion of the transport rollers 24 from the detection position, so that the movable guide portion 52 moves to the close position when the sheet 70 passes through the nip portion. A time since the sheet 70 passes through the detection position of the sensor 26 until the sheet 70 passes through the nip portion of the transport rollers 24 can be obtained, for example, according to a distance from the detection position of the sensor 26 to the nip portion of the transport rollers 24, and a transport speed of the sheet 70.

Also, the guide drive control unit 204 drives the guide drive cam 54 so as to return the movable guide portion 52 to the apart position at given timing, after the rear edge of the sheet 70 passes through the nip portion of the transport rollers 24. If the acting-up of the sheet occurring when the rear edge of the sheet 70 passes through the transport rollers 24 is suppressed, a timing at which the movable guide portion 52 is returned to the apart position is not limited.

Accordingly, for example, if the movable guide portion 52 is at the close position when the rear edge of the sheet 70 where at least acting-up of the sheet 70 occurs, passes through the transport rollers 24, the guide drive control unit 204 may thereafter drive the guide drive cam 54 to return the movable guide portion 52 to the apart position before the rear edge of the sheet 70 passes through the secondary transfer position T.

Also, the guide drive control unit 204 continuously moves the movable guide portion 52 to the close position since a timing when the rear edge of the sheet 70 passes through the transport rollers 24 until the rear edge of the sheet 70 passes through the secondary transfer position T. Then, after the sheet 70 passes through the secondary transfer position T, the guide drive control unit 204 may drive the guide drive cam 54 so as to return the movable guide portion 52 to the apart position. Whether the rear edge of the sheet 70 passes through the secondary transfer position T, or not, can be determined on the basis of a detection signal from a sensor that detects the pass of the sheet 70 and is disposed downstream of the secondary transfer position T in the sheet 70 transport direction.

It is preferred that before the rear edge of the sheet 70 passes through the transport roller, a contact area of the sheet 70 and the intermediate transfer belt 8 is made larger so that the transfer property of the toner image onto the sheet from the intermediate transfer belt 8 is enhanced. Accordingly, it is preferred that the guide drive control unit 204 continuously moves the movable guide portion 52 to the apart position until the rear edge of the sheet 70 passes through the transport rollers 24.

The configuration and functions of the image forming apparatus 1 according to this embodiment are described above. According to the image forming apparatus 1 of this embodiment, when the rear edge of the sheet 70 passes through the transport rollers 24 disposed before the secondary transfer position T, the contact area of the sheet 70 and the intermediate transfer belt 8 can be reduced. Since the contact area of the sheet 70 and the intermediate transfer belt 8 is reduced, even the sheet 70 flaps and acts up immediately after the rear edge of the sheet 70 passes through the transport rollers 24, the sheet 70 can be prevented from being rubbed with and contacting the intermediate transfer belt 8. Accordingly, the rubbed toner image can be prevented from adhering to the sheet 70 so that the image goes wrong, and high-quality image forming can be performed.

Also, according to the image forming apparatus 1 of this embodiment, when the rear edge of the sheet 70 passes through the transport rollers 24, the movable guide portion 52 moves to the close position to the fixed guide portion 60, and the interval between the guide surfaces thereof become small. As a result, even if the sheet 70 flaps and acts up when the sheet 70 passes through the transport roller, because the sheet 70 is held between the guide surfaces, the acting-up of the sheet 70 can be suppressed to the minimum. Accordingly, the sheet 70 can be more surely prevented from being rubbed with and contacting the intermediate transfer belt 8 so that the image goes wrong.

Figure 5:
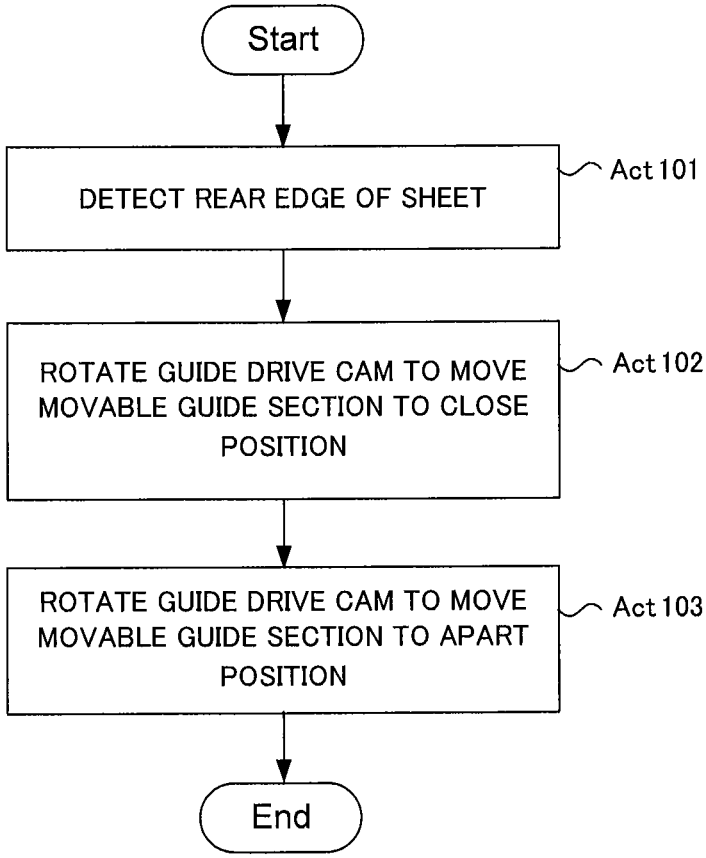
FIG. 5 is a flowchart for describing a flow of guide processing.

Subsequently, a description will be given of a flow of guiding (transporting method of the sheet 70) which can prevent the sheet 70 from being rubbed against the intermediate transfer belt 8 due to the guide section 50 in the image forming apparatus 1 according to this embodiment. FIG. 5 is a flowchart for describing a flow of guiding.

First, the detection signal acquisition unit 202 acquires a detection signal indicating that the rear edge of the sheet 70 passes through the detection position of the sensor 26, from the sensor 26 (Act 101).

Then, the guide drive control unit 204 controls the cam drive portion that drives the guide drive cam 54, rotates the guide drive cam 54, and moves the movable guide portion 52 to the close position at a timing when the sheet 70 passes through the transport rollers 24 (Act 102).

Subsequently, when the movable guide portion 52 is at the close position, the rear edge of the sheet 70 has already passed through the transport rollers 24, and at the time when the acting-up of the sheet 70 stops occurring, the guide drive control unit 204 controls the cam drive portion, rotates the guide drive cam 54, and returns the movable guide portion 52 to the apart position (Act 103). As described above, if the movable guide portion 52 is kept to move to the close position until the rear edge of the sheet 70 passes through the secondary transfer position T, at the timing after the rear edge of the sheet 70 passes through the secondary transfer position T, the guide drive control unit 204 may rotate the guide drive cam 54 to return the movable guide portion 52 to the apart position.

The flow of guiding the sheet 70 in the image forming apparatus according to this embodiment is described above.

In this embodiment, the fixed guide portion 60 is provided as the guide section 50 as described above. However, the guide section 50 is not limited to this configuration. The guide section 50 does not always include the fixed guide portion 60. As described above, the acting-up of the sheet 70 can be suppressed with provision of the fixed guide portion 60 when the movable guide portion 52 moves to the close position. However, if the movable guide portion 52 moves to change the feed position of the sheet 70 to the intermediate transfer belt 8 so as to reduce the contact area of the sheet 70 and the intermediate transfer belt 8, that the sheet 70 and the intermediate transfer belt 8 are rubbed with and contact each other can be suppressed. Accordingly, with provision of only the movable guide portion 52, when the rear edge of the sheet 70 passes through the transport rollers 24, the movable guide portion 52 may move so as to reduce the contact area of the sheet 70 and the intermediate transfer belt 8.

Also, in this embodiment, the guide drive cam 54 is rotated by the cam drive portion such as a motor as described above. However, the guide drive cam 54 is not limited to this configuration. For example, the support shaft 56 of the guide drive cam 54 is connected through a gear to a driving source arranged to rotate the other transport rollers and the members in the process units 100, so that the guide drive cam 54 can rotate. In this case, the driving source to be coupled and the support shaft 56 of the guide drive cam 54 are connected to each other through a clutch, and the guide drive control unit 204 may control the operation of the clutch to operate the guide drive cam 54. Specifically, if the guide drive cam 54 is intended to rotate, the guide drive control unit 204 engages the clutch under the control. If the guide drive cam 54 is not intended to rotate, the guide drive control unit 204 disengages the clutch under the control.

Further, in this embodiment, as means for moving the movable guide portion 52, the cam (the guide drive cam 54) is exemplified. However, the means is not limited to this configuration. For example, the movable guide portion 52 and a driving source for moving the movable guide portion 52 may be connected directly to each other through a gear, and the movable guide portion 52 may move not through a cam. In this case, as the driving source, for example, a stepping motor may be used so that the movable guide portion 52 can be accurately moved to the close position and the apart position.

Also, in this embodiment, as the guide section 50, the movable guide portion 52 that comes close to or moves away from the fixed guide portion 60 is exemplified. However, the guide section 50 is not limited to this configuration. As described above, if the contact area of the sheet 70 and the intermediate transfer belt 8 is reduced, the sheet 70 can be prevented from being rubbed with the intermediate transfer belt 8. Therefore, a guide member may be provided for changing a direction of feeding the sheet 70 to the intermediate transfer belt 8 so as to reduce the contact area.

Figure 6:
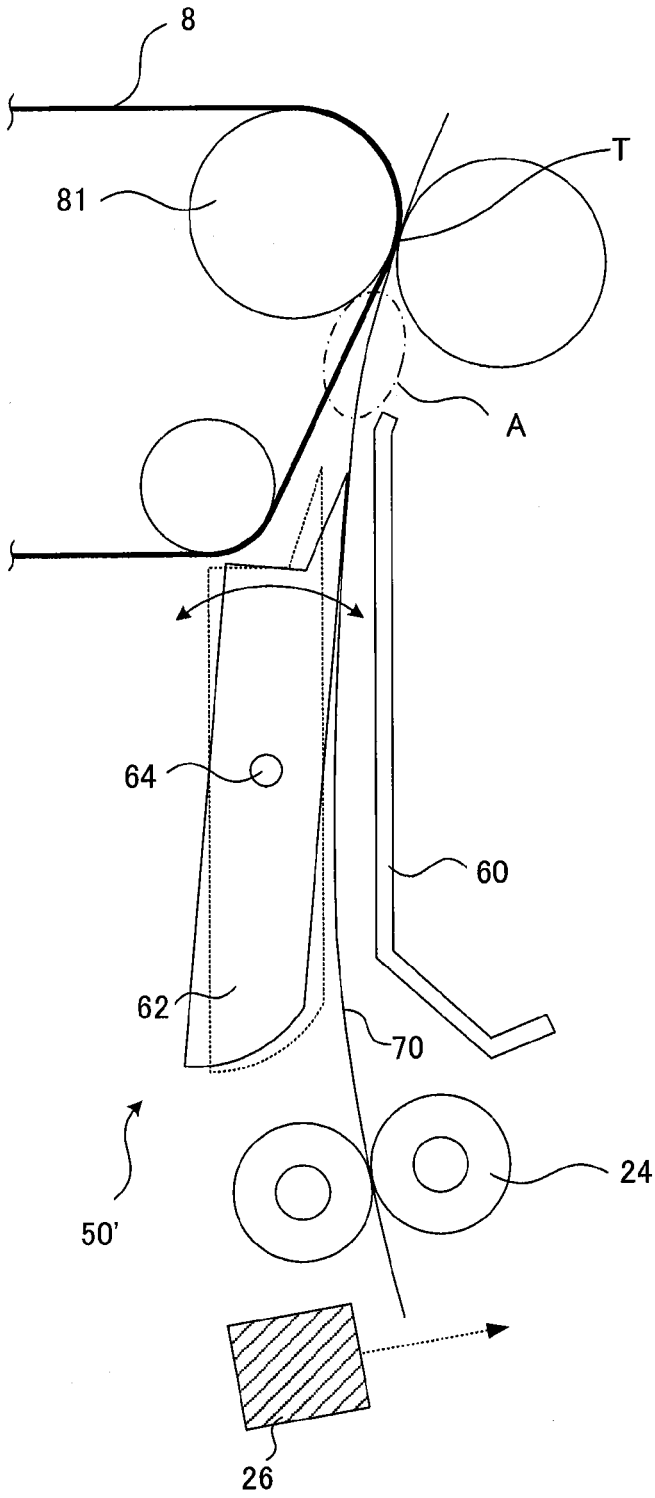
FIG. 6 is an enlarged diagram illustrating a part of secondary transfer in an image forming apparatus according to a modified example.

For example, as illustrated in FIG. 6, a rotating guide portion 62 that is rotatably supported by a support shaft 64 may be provided. In the case of the rotating guide portion 62, the rotating guide portion 62 rotates so that the secondary transfer position T side of the rotating guide portion 62 comes close to the fixing guide portion 60 when the rear edge of the sheet 70 passes through the transport rollers 24. With this operation, the transporting direction of the sheet 70 is so changed as to reduce the contact area of the sheet 70 and the intermediate transfer belt 8. Thus, the guide section 50 may change the transporting direction of the sheet 70 to the intermediate transfer belt 8 as illustrated in FIG. 6 to reduce the contact area of the sheet 70 and the intermediate transfer belt 8 so that the rubbing of the sheet 70 can be suppressed.

Also, in this embodiment, a system in which the toner image is formed on the intermediate transfer belt 8, and the transferred toner image is transferred onto the sheet 70 at the secondary transfer position T is described above. However, the transfer system is not limited to this configuration. The method described in this embodiment can be applied also to a system in which the toner image is transferred from the photosensitive drum directly to the sheet. That is, the supply position or the supply angle of the sheet to the photosensitive drum may be changed so that the contact area with the photosensitive drum is reduced when the rear edge of the sheet passes through the transport roller.

As described in detail above, according to this embodiment, there can be provided the image forming apparatus that can form a high-quality image without the toner image being rubbed with and transferred onto the sheet.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an image carrier configured to carry a toner image that is to be transferred onto a sheet;

a transport roller that is disposed upstream in a sheet transport direction with respect to a transfer position where the toner image is transferred onto the sheet from the image carrier;

a sensor configured to detect a passing of the sheet at a position upstream in the sheet transport direction with respect to the transport roller;

a guide section that is arranged between the transfer position and the transport roller, and configured to be changed between a first guide state in which the transported sheet is guided so as to contact a surface of the image carrier with a first contact surface area, and a second guide state in which the transported sheet is guided so as to contact the surface of the image carrier with a second contact surface area that is smaller than the first contact surface area, the guide section including:

a fixed guide that is fixed at a given position and has a first guide surface;

a movable guide that has a second guide surface facing the first guide surface and configured to be moved between first and second positions, the guide section being in the first guide state when the movable guide is moved into the first position and in the second guide state when the movable guide is moved into the second position;

a support shaft;

a cam configured to rotate about the support shaft and move the movable guide;

an elastic member that has one end joined to a first member fixed to the support shaft and the other end joined to the movable guide, and urges the movable guide towards the first member; and a positioning member that has one end joined to the first member, and configured to hold the movable guide urged towards the first member by the elastic member in the first position; and a guide control section configured to acquire from the sensor a detection signal indicating the passing of the sheet, and control the guide section to guide the transported sheet in the second guide state when the guide control section determines on the basis of the acquired detection signal that a rear edge of the transported sheet has passed through the transport roller.

2. The apparatus according to claim 1, wherein an interval between the guide surface of the movable guide at the second position and the guide surface of the fixed guide is smaller than an interval between the guide surface of the movable guide at the first position and the guide surface of the fixed guide.

3. The apparatus according to claim 1, wherein the guide control section is configured to control the guide section to guide the transported sheet in the first guide state after a given time elapses since the guide control section acquired the detection signal from the sensor.

4. The apparatus according to claim 1, wherein the image carrier is a transfer belt.

5. A sheet transporting method in an image forming apparatus including:

an image carrier configured to carry a toner image that is to be transferred onto a sheet;

a transport roller that is disposed upstream in a sheet transport direction with respect to a transfer position where the toner image is transferred onto the sheet from the image carrier;

a sensor configured to detect a passing of the sheet at a position upstream in the sheet transport direction with respect to the transport roller; and a guide section that is arranged between the transfer position and the transport roller, and configured to be changed between a first guide state in which the transported sheet is guided so as to contact a surface of the image carrier with a first contact surface area, and a second guide state in which the transported sheet is guided so as to contact the surface of the image carrier with a second contact surface area that is smaller than the first contact surface area, the guide section including:

a fixed guide that is fixed at a given position and has a first guide surface;

a movable guide that has a second guide surface facing the first guide surface and configured to be moved between first and second positions, the guide section being in the first guide state when the movable guide is moved into the first position and in the second guide state when the movable guide is moved into the second position;

a support shaft;

a cam configured to rotate about the support shaft and move the movable guide;

an elastic member that has one end joined to a first member fixed to the support shaft and the other end joined to the movable guide, and urges the movable guide towards the first member; and a positioning member that has one end joined to the first member, and configured to hold the movable guide urged towards the first member by the elastic member in the first position, the method comprising:

acquiring from the sensor a detection signal indicating the passing of the sheet;

determining on the basis of the acquired detection signal that a rear edge of the transported sheet has passed through the transport roller; and controlling the guide section to guide the transported sheet in the second guide state when it is determined that the rear edge of the transported sheet has passed through the transport roller.

6. The method according to claim 5, wherein an interval between the guide surface of the movable guide at the second position and the guide surface of the fixed guide is smaller than an interval between the guide surface of the movable guide and the guide surface of the fixed guide.

7. The method according to claim 5, further comprising:

controlling the guide section to guide the transported sheet in the first guide state after a given time elapses since the guide control section acquired the detection signal from the sensor.

8. The method according to claim 5, wherein the image carrier is a transfer belt.

* * * * *

UNITED STATES PATENT AND TRADEMARK OFFICE

CERTIFICATE OF CORRECTION

PATENT NO. : 8,611,807 B2
APPLICATION NO. : 13/090487
DATED : December 17, 2013
INVENTOR(S) : Hidetoshi Murao It is certified that error appears in the above-identified patent and that said Letters Patent is hereby corrected as shown below:

In the Claims

In column 11, Claim 6, line 23, please insert --at the first position-- after "moveable guide"

Signed and Sealed this
Twenty-seventh Day of May, 2014

Michelle K. Lee

Michelle K. Lee
*Deputy Director of the United States Patent and Trademark Office*